US006095212A

United States Patent [19]

Izumi et al.

[11] Patent Number: 6,095,212

[45] Date of Patent: Aug. 1, 2000

[54] LUMBER PRODUCTION MACHINE NOT REQUIRING SEASONING AND MANUFACTURING METHOD THEREOF

[76] Inventors: Hyogo Izumi, deceased, late of Kobe; by Masanori Izumi, heir, Kobe Portvillage No. 2-1324, 1-2, Minatojimanaka-machi 3-chome, Chuou-ku, Kobe-city, Hgoyo 650-0046; by Takayoshi Izumi, heir, Seishinchuou Westage No. 2-702, 26, Koujidai 2-chome, Nishi-ku, Kobe-city, Hyogo 651-2273, all of Japan

[21] Appl. No.: 09/146,073

[22] Filed: Sep. 2, 1998

[30] Foreign Application Priority Data

Sep. 2, 1997 [JP] Japan ..... 9-254146

[51] Int. Cl.[7] ..... B27M 1/00; B27H 1/00

[52] U.S. Cl. ..... 144/380; 144/2.1; 144/271; 144/359; 144/364

[58] Field of Search ..... 144/2.1, 271, 359, 144/361, 380, 364, 356; 428/98, 106; 427/369, 370, 393, 440; 425/385

[56] References Cited

U.S. PATENT DOCUMENTS 2,505,302 4/1950 Ramsey, et al. ..... 144/271 C X
3,030,711 4/1962 Warring ..... 144/271
4,325,420 4/1982 Zeloof ..... 144/271
5,343,913 9/1994 Tanahashi et al. ..... 144/271

*Primary Examiner*—W. Donald Bray
*Attorney, Agent, or Firm*—Smith Patent Office

[57] ABSTRACT

A lumber production machine and method for processing lumber uses a pressure vessel that can accommodate untreated lumber and an injection pipe disposed in the pressure vessel that is capable of injecting saturated steam into the pressure vessel. A pressure gauge is operatively coupled to pressure vessel to determine the pressure inside the pressure vessel. There is a mechanism for setting a minimum and maximum pressure inside the pressure vessel. Solenoid valves control injection of saturated steam from the injection pipe into the interior of the pressure vessel. A controller opens the solenoid valves when the minimum pressure is reached and closes the solenoid valve when the maximum pressure is reached. The method includes pressurizing and heating the lumber products with saturated steam by varying the pressure to achieve a uniform temperature inside the lumber. The pressurizing and heating step including providing saturated steam in the pressure-vessel type production machine; discharging the saturated steam of the production machine; introducing saturated steam back into the pressure-vessel type production machine for additional pressurization and heating. This introduction and discharging process can be repeated using varying pressures and the steam is provided providing in the machine in the range of 40 to 90 seconds.

5 Claims, 2 Drawing Sheets

LUMBER PRODUCTION MACHINE NOT REQUIRING SEASONING AND MANUFACTURING METHOD THEREOF

BACKGROUND OF THE INVENTION

1. Field of the Invention

The present invention relates to a machine for lumber production that produces lumber boards as well as to the manufacturing method thereof.

2. Discussion of the Related Art

The lumber seasoning theory in the world is based on the premise in that natural water contained in vessels, capillary tubes, and cell cavities (comprising the lumber tissue) is unable to be uniformly liberated. Based on this theory, various lumber seasoning techniques have been established and various seasoning machines have been built. Lumber is a material that contracts as the water content decreases. If the liberating condition of the water contained in the tissue of the lumber differs, the rate of contraction differs from part to part. Consequently, lumber academies and the lumbering industry had knowledge that 1) lumber generates various deformations and warps in the lumber drying process and 2) deformation and warpage stop when the water contained in the lumber finishes being liberated, and 3) it is not possible to stop generation of deformations or cracks unless the drying is finished.

About 30 years ago, the inventor found that lumber 4 meters long by 300 mm square dried without generating deformations or cracks when the lumber was placed in a pressure vessel just after lumbering and pressurized and heated with saturated steam only once, and left as it was. This phenomenon occurs only when the lumber is pressurized and heated with saturated steam in a pressure vessel, but the inventor was unable to determine why this kind of phenomenon occurred. Therefore, the inventor thought that the basic premise of the lumber seasoning theory might be incorrect. The inventor then requested that Forestry Experiment Station of the Japanese Government Organization to conduct research into this subject. However, they did not make any research into this topic.

Another problem that remained unsolved was that the plant equipped with a pressure vessel installed a once-through boiler for the boiler. The steam pressure of about 3 $kg/cm^2G$ was required for pressure of the saturated steam to be injected from the injection pipe inside the pressure vessel and the steam pressure was held constant by allowing the steam pressure generated in the boiler to pass the pressure reducing valve. However in the case of the once-through boiler, steam of various pressures was generated simultaneously due to the properties of the once-through boiler, and it was not possible to determine whether the steam of a pressure lower than 3 $kg/cm^2G$ was generated or not. That is, the people did not understand that the once-through boiler is not worth while as a proper boiler, that is, it should not be used as a boiler.

Because the lumber academies have not realized that the premise of the conventional lumber seasoning theory is mistaken, there is a limit in lumber thickness that lumber manufacturers are able to season. Further, the lumber manufacturers continue to use a seasoning method that results in poor yield. They typically use a method of natural seasoning combined with hot-air seasoning and no attempt has been made to correct the actual conditions which generate enormous losses and aggravate global warming.

SUMMARY OF THE INVENTION

The primary object of this invention is to enable a production method which does not need any artificial seasoning. This object is accomplished by lumber that can naturally and uniformly liberate water contained in the lumber in a short time no matter how thick the lumber product is, and at the same time, eliminate losses such as deformations and cracks so as to improve the product yield ratio by more than 50%.

The present invention related to a lumber production machine for making processing lumber comprising a pressure vessel that can accommodate untreated lumber; an injection pipe disposed in the pressure vessel, the injection pipe being capable of injecting saturated steam into the pressure vessel; a pressure gauge operatively coupled with the pressure vessel to determine the pressure inside the pressure vessel; setting means for setting a minimum and maximum pressure inside the pressure vessel; a solenoid valve for controlling injection of saturated steam from the injection pipe; and a controller for opening the solenoid valve when the minimum pressure set by the setting means is reached and closing the solenoid valve when the maximum pressure set by the setting means is reached.

The present invention can also include a pressure gauge which is a three-pointer pressure gauge where the minimum and maximum pressures inside the pressure vessel can be set with two pointers. The lumber production machine can also include a pressure gauge that includes a pointer for indicating the pressure inside the pressure vessel. The lumber production machine includes a connection to a boiler that is made through a pressure reducing valve so that saturated steam can pass from the boiler to the pressure reducing valve and then to the pressure vessel.

The present invention also relates to a manufacturing method for forming lumber that does not need any artificial seasoning, comprising the steps of placing lumber products containing natural water in a pressure-vessel type production machine; pressurizing and heating the lumber products with saturated steam with pressure varying between first maximum and minimum pressures, the pressurizing and heating step including providing saturated steam in the pressure-vessel type production machine at substantially 3 $kg/cm^2G$ or higher; pressurizing and heating the lumber products with saturated steam with pressure varying between second maximum and minimum pressures, this pressurizing and heating step including providing saturated steam in the pressure-vessel type production machine at substantially 3 $kg/cm^2G$ or higher; controlling the saturated steam pressure in the vessel so that the time between the first minimum pressure and first maximum pressure is in the range of 40 to 90 seconds, and discharging the saturated steam of the production machine to produce a boiling phenomenon for the natural water.

When Asian black-and-white paintings are drawn, a small porcelain water-dispensing tool is used. Water can be poured in the water-dispensing tool because there are two small holes in the water-dispensing tool. If there is only one hole in the water-dispensing tool, water in the water-dispensing tool does not come out nor water is able to be poured in. The lumber tissue comprises cell cavities which have a similar tissue structure to the water-dispensing tool with one hole, pipe-like vessels, and capillary tubes. Lumber academies have established the lumber seasoning theory on the assumption that it is impossible to liberate the water contained in the cell cavities at the same ratio as that of liberating water contained in vessels and capillary tubes. They did not research moving water contained in the cell cavities at the same ratio as that of moving water contained in vessels and capillary tubes.

It is a common knowledge that as the water contained in the lumber is liberated, contraction occurs in the lumber.

Unless water contained in the cell cavities of the lumber is liberated at the same ratio as that of the water contained in vessels or capillary tubes, different contraction rates occur, and cracks or deformations are certain to result.

For measures to liberate contained water existing in the lumber from its initial state when the tree is cut down, evaporation and boiling exist. If water contained in the lumber is liberated using evaporation under natural conditions, the contained water is liberated from the lumber surface and unevenness occurs in the water content, a difference in the contraction rates occurs, and it is not possible to prevent cracks or deformations from occurring.

If contained water is liberated by boiling, it is possible to create a condition that can uniformly boil the contained water in cell cavities, vessels and capillary tubes.

When saturated steam is used to heat and constantly pressurize the whole lumber product at 1 kg/cm$^2$G or higher without generating cracks or deformations in the lumber product, there exist trees that begin to have a cell cavity collapsing phenomenon depending on the kind of tree and the limits of the pressure applied. Therefore, it is impossible to provide a pressure and heat that can boil and evaporate all of the contained water in all lumber.

If lumbering is carried out or the lumber product is pressurized and heated, the lumber and also the contained water in the lumber product must be heated. Because the specific heat of water is three times as large as that of the lumber, it is not easy to heat the lumber that possesses the contained water.

It is well known that if convection is able to be generated in water when water is being heated, the water temperature can be easily raised. Under normal conditions, convection cannot occur in the contained water existing in the tissue in the lumber, but if another method that can be substituted with convection, the lumber having more contained water can be heated easily.

BRIEF DESCRIPTION OF THE DRAWINGS

The above and other objects and features of the present invention will be clearly understood from the following description with respect to the preferred embodiments thereof when considered in conjunction with the accompanying drawings, wherein the same reference numerals have been used to denote the same or similar parts or elements, and in which.

DETAILED DESCRIPTION OF THE PREFERRED EMBODIMENTS

Figure 1:
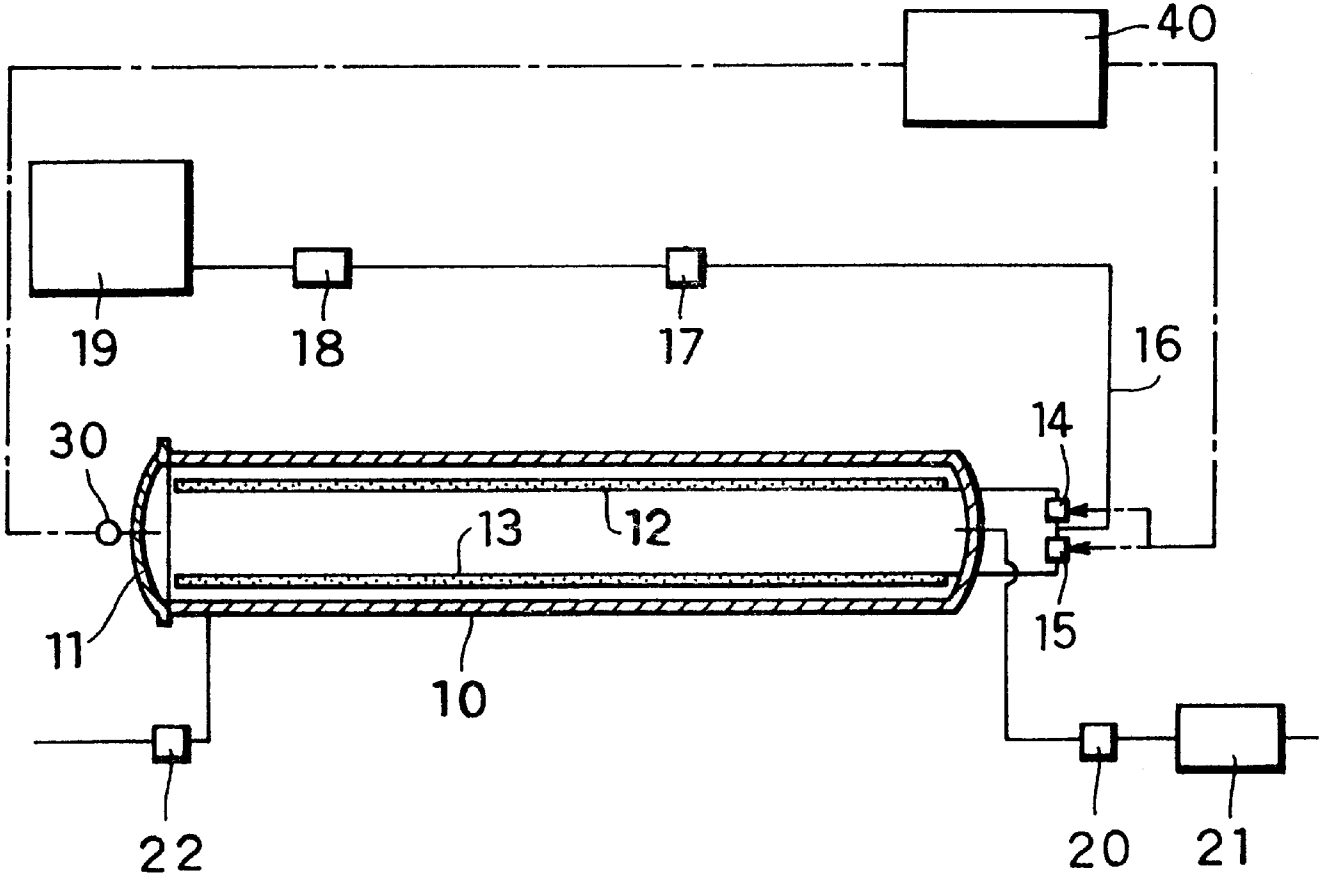
FIG. 1 is a schematic representation of one embodiment of the lumber production machine according to the present invention for forming the lumber that does not need any artificial seasoning.
Figure 2:
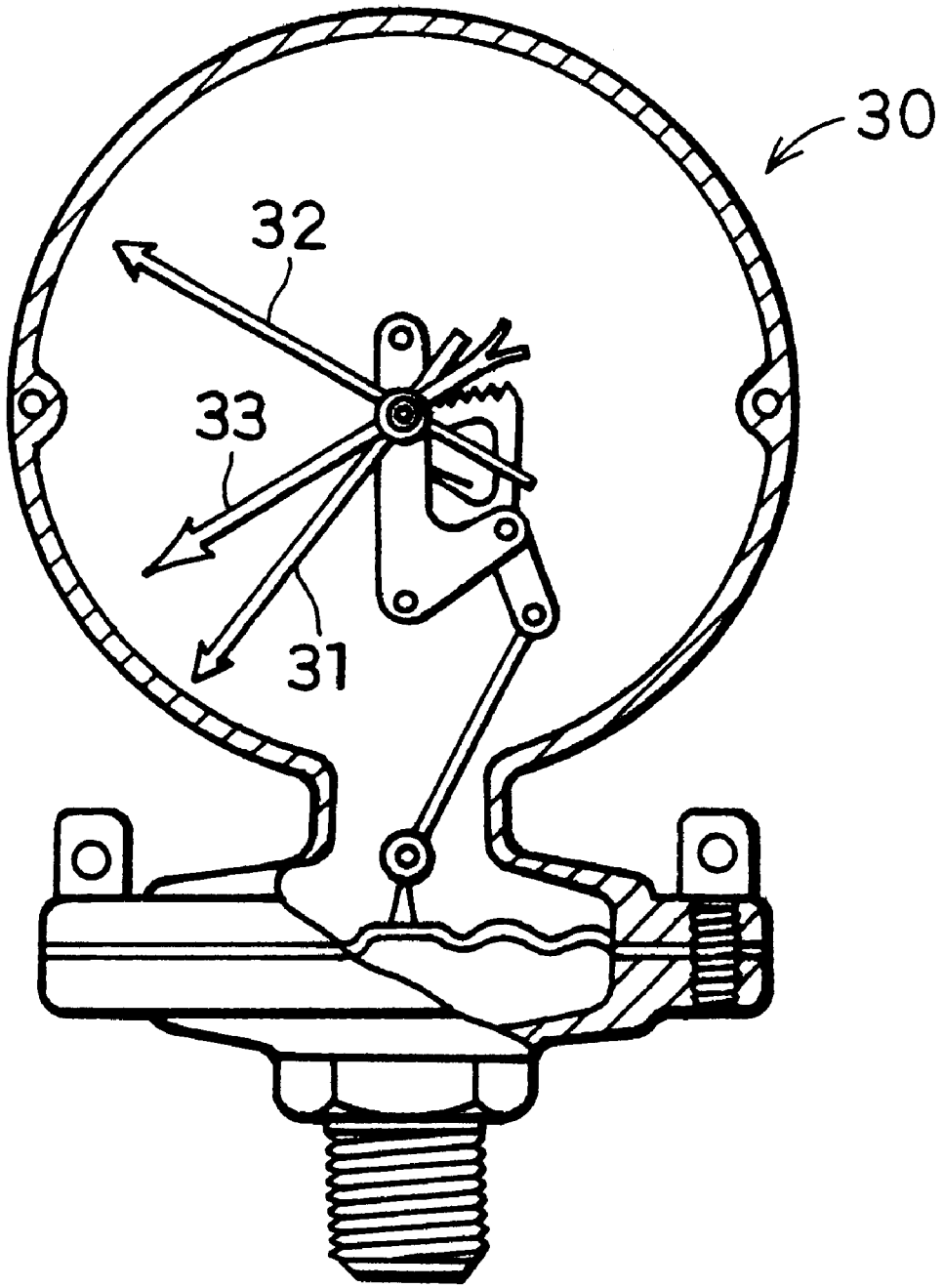
FIG. 2 is a side view, partially in section, showing one embodiment of a three-pointer pressure gauge used in the lumber production machine according to the present invention.

Referring now to drawings, the embodiments of the invention will be described in detail hereinafter. FIG. 1 and FIG. 2 show preferred embodiments of the production machine according to the invention for forming lumber that does not need artificial seasoning. The production machine primarily comprises a cylindrical pressure vessel 10 having a front door 11 installed thereon so that it is free to open and close. Inside the vessel 10, a bed (not shown) is installed so that the lumber to be treated can be placed thereon.

Inside the pressure vessel 10 are injection pipes 12 and 13 that have a large number of through holes arranged in the longitudinal direction. The injection pipes 12, 13 are connected to a boiler 19 via solenoid valves 14, 15, common pipeline 16, valve 17, and pressure reducing valve 18.

The pressure vessel 10 is also connected to a vacuum pump 21 via valve 20. A condensed water discharge valve 22 is also installed and is in fluid communication with the pressure vessel 10.

A three-pointer pressure gauge 30 is attached to the pressure vessel 10. This pressure gauge 30 is able to set the minimum and the maximum pressures inside the pressure vessel 10. One way of setting the pressure is by using two pointers 31, 32 which function as a setting means. The pressure gauge 10 can also indicate pressure inside the pressure vessel 10 with a remaining pointer 33. A mechanism or sensor (not shown) is installed so that it is operatively connected to the pressure gauge 30. The mechanism or sensor can mechanically or electrically detect the point when the actual pressure is almost equal to either the minimum pressure or the maximum pressure. This mechanism or sensor can then detect this condition and it is entered in the controller 40. This controller 40 in turn closes the solenoid valves 14, 15 at the maximum pressure, and opens the solenoid valves 14, 15 at the minimum pressure.

How to produce lumber products that do not need artificial seasoning according to the invention will now be described. In addition, various new products which have never been able to be considered using conventional lumber seasoning theory can now be produced using a process for forming lumber that liberates the water contained in the lumber product naturally and uniformly.

By this invention, it is possible to form a board of any thickness that can uniformly liberate the contained water. Lumber products having uniform thickness are piled up and placed in a pressure-vessel type production machine. A door 11 is then closed, a condensed water discharge valve 22 attached to the machine bottom is opened, and solenoid valves 14, 15 are opened to inject the saturated steam with steam pressure of about 3 kg/cm$^2$G or higher into the machine. Low-temperature air inside the machine is discharged and some of the steam is vigorously discharged out from the condensed water discharge valve 22. Then condensed water is formed on the low-temperature lumber surface and it wets the surface. Following this the opening of the condensed water discharge valve is reduced and the pressure inside the machine begins to increase.

When the pressure inside the machine increases and reaches 0.7 kg/cm$^2$G set by the maximum pressure pointer 32 of the three-pointer type pressure gauge 30, injection of the saturated pressure is stopped by closing the solenoid valves 14, 15 by the controller 40. Because the saturated steam in the machine continues to be discharged from the condensed water discharge valve 22, the pressure in the machine is lowered. When the pressure reaches 0.4 kg/cm$^2$G or lower set by the minimum pressure pointer 31 of the pressure gauge 30, the solenoid valves 14, 15 are opened to resume injection of saturated steam having a pressure of 3 kg/cm$^2$G or higher. With these pressure limits maintained, the lumber products are repeatedly pressurized and heated by the saturated steam as the injection and stopping steps are repeated for a predetermined period. This predetermined period is equal to the thickness of the lumber products placed in this machine in millimeters divided by 2 (units are minutes). For example, if the lumber has a 20 millimeter thickness, then the repeated injections and stopping steps are continued for 10 minutes.

For the controller 40, a known mechanism for electrically or mechanically detecting the motion of the pointer 33 of the pressure gauge 30 and electrically controlling the solenoid valves can be adopted. Also, the pressure can be remotely detected without a gauge having a pointer.

After the predetermined period passes, the settings of the pressure gauge 30 are changed to increase the pressure range for pressurization and heating by the saturated steam between 1.0 kg/cm$^2$G and 0.7 kg/cm$^2$G or lower. The saturated steam is then repeatedly injected and stopped for a duration of time equal to the predetermined period. Using this technique, the internal temperature of the lumber naturally reaches 120° C.

When the internal temperature of the lumber product is 120° C., which is higher than the water boiling point in atmospheric pressure, condensed water collecting inside the pressure-vessel type production machine is discharged from the condensed water discharge valve 22. Also the pressurized saturated steam inside the vessel begins to discharge, lowering the pressure as it is discharged. Then the contained water inside the lumber product begins boiling all at once, and each cell cavity begins to have hollow cavities formed in the section where the contained water has been liberated.

When dispensing the saturated steam from the condensed water discharge valve 22 progresses and the pressure of the saturated steam inside the pressure vessel-type production machine becomes 0.3 kg/cm$^2$G or lower, the pressure lowering speed slows. Then, the condensed water discharge valve 22 is closed and the vacuum pump 21 is operated. When the pressure inside the production vessel lowers below atmospheric pressure, the safety apparatus on the door 11 of the pressure vessel 10 is canceled, and the vacuum pump 21 stops operating. With the boiling steam from the lumber product inside this machine, the door 11 begins to open automatically.

The condensed water discharge valve 22 is opened, the condensed water collecting at the bottom of this machine is discharged, and air is introduced to achieve atmospheric pressure. The door 11 is then fully opened, and the lumber products are removed from this machine.

By this treatment, the inside of the lumber is uniformly pressurized by this series of saturated steam. Therefore the following comments can be made in connection with the present invention.

1. When raw wood is lumbered, the lumber product has a property so that it warps on the opposite side from the center of the raw wood. The board that used to warp due to this effect can be made flat by this series of treatments, and even if the board is cut, the warpage will not occur again.
2. It was previously thought that lumber with a flat grain warps in the form of cup and straight grain lumber cross-warps. This was believed to be uncorrectable, however with this series of treatments, this effect did not occur. Therefore the warping phenomenon that occurs is due to the difference of the contraction rates resulting from lowering of the water content.
3. Previously it was difficult to remove the contained water in the cell cavities. Since the contraction rates differed from part to part, generation of cracks and deformations in the lumber was believed to be inevitable. However using the series of treatments in the pressure-vessel type production machine according to the present invention, the contained water inside each cell cavity is able to move to the hollow portion of the adjoining cell cavity and it can be uniformly liberated as in the case of the water contained in the pipe-form vessels and capillary tubes.

When the lumber product is taken out from the pressure-vessel type production machine it generates a thick cloud of steam for about 2 hours and it is soft for a time thereafter. The board can be taken out and lumbered by a thin saw into a desired thickness or width where a contraction tolerance has been added to the thickness of the desired product. It is then piled on battens. By this method, losses such as cracks or deformations are not generated even with lumber products which are lumbered and reduced. This method achieves a water content ranging from 20 to 22%, which secures easy processing, in a short time. When the lumber attains this water content ratio, lumber processing except superfinishing is carried out. The surface area is further increased and again piled on battens and stacked in a large room controlled to the humidity at which lumber is kept. The lumber reaches the equilibrium water content after a short time in the room.

In this series of treatments, the pressure-vessel type production machine only treats lumber by varied saturated steam. It eliminates all of the lumber seasoning processes that provide extremely poor yield ratio and high-quality lumber products can be obtained. This process is not typical seasoning so the word "lumber seasoning" may become an obsolete word.

Therefore according to one embodiment of the present invention, the method includes:

1. Inserting equally thickness-sized lumber in the vessel and closing the door.
2. Valve 22 is opened, then saturated steam (pressure of 3 kg/cm$^2$G or higher) is added into vessel, thereby low temperature air in vessel is discharged.
3. When the condensed water is generated on the lumber, the opening of valve 22 is reduced thereby pressure in vessel increase.
4. When pressure in the vessel reaches 0.7 kg/cm$^2$G on the pressure gauge, injection of saturated steam (pressure of 3 kg/cm$^2$G or higher) is stopped, thereby pressure in the vessel is reduced via valve 22.
5. When the pressure in the vessel reaches 0.4 kg/cm$^2$G or lower, injection of saturated steam is restarted and pressure in vessel increases 0.7 kg/cm$^2$G.
6. Steps 4 and 5 are repeated for a predetermined period. These repeated steps comprise the 1$^{st}$ pressurizing step. Above the predetermined period is determined based on the following: When lumber has a thickness of X mm, X/2 minutes is predetermined period.
7. When above predetermined period has passed, the maximum and minimum pressure of the pressure gage are changed to 1 kg/cm$^2$G and 0.7 kg/cm$^2$G.
8. Pressurizing by injecting and stopping saturated steam of varying pressure mentioned above is run for the predetermined period at the higher limits. Thereby the internal temperature of the lumber reaches 120° C. This is the 2$^2$nd pressurizing step.
9. When predetermined period of the 2$^{nd}$ pressurizing step has passed, valve 22 is opened thereby saturated steam in vessel is discharged and the contained water in the lumber is liberated.

The amount the opening of valve 22 is reduced is dependent upon making the time between the minimum and maximum pressure in the vessel be 40–90 seconds.

The following discussion is theoretically based and is an attempt to explain why this process is effective. The reason why the saturated steam with pressure about 3 kg/cm$^2$G or higher is injected with the condensed water discharge valve open in the first process step is that air in the production machine is discharged and at the same time, the whole product lumber is wetted to achieve a uniform temperature inside the lumber product. This prevents damage to the lumber when it is heated.

In this process lumber products are piled up in the pressure vessel to pressurize and heat them with saturated steam. Operations open the solenoid valve which operates and begins to inject saturated steam that comes from the boiler via the pressure reducing valve through the injection pipe into the pressure vessel when the pressure gauge indicates the minimum pressure. Operations close the solenoid valve that operates and stops the injection of saturated steam when the pressure gauge indicates the maximum pressure. These steps are repeated so that fluctuated saturated steam pressure as described above is applied to the pressure-vessel type production machine.

When the saturated steam comes in contact with the low temperature lumber products, condensed water is generated on the surface of the lumber products. So when the saturated steam is injected to the vessel to put the lumber under a pressurized state, the high-temperature condensed water passes through the vessels of the lumber and is pressed into the inside of the lumber product. Conversely, when the injection of the saturated steam is stopped, the low-temperature water contained inside the lumber product reacts and moves towards the surface of the lumber product. Repeating the injection and stopping the saturated steam steps repeats the mixed state of high-temperature condensed water and low-temperature contained water. The temperature of the water contained inside the lumber product gradually increases.

The reason why pressurization and heating by the saturated steam is divided into two stages is that if the high-temperature saturated steam is pressurized and heated in one stage, the temperature difference between the high-temperature condensed water generated on the surface of the lumber product and the low-temperature contained water at the core portion of the lumber product is excessively large. This gives rise to the condition where it becomes difficult to mix the high-temperature condensed water with the low-temperature contained water. Therefore, if the temperature of the contained water at the lumber core portion is preheated, it becomes easier to allow the contained water to move to the surface as the saturated steam pressure varies. But if fluctuated pressurization and heating using high-temperature saturated steam takes place without undergoing the above-mentioned treatment, the low-temperature contained water at the core portion of the lumber product is difficult to move. This causes a low-temperature water lump to form at the core portion and so the internal temperature of the lumber product is not uniform.

In the pressure-vessel type production machine, the reason why the steam pressure to be injected into the machine must be 3 kg/cm$^2$G or higher in spite of the pressurizing pressure of the saturated steam that is 1 kg/cm$^2$G is described as follows:

1. Injecting about 3 kg/cm$^2$G or higher saturated steam enables the high-temperature condensed water to be easily generated on the surface of the lumber product because of the temperature difference between the lumber surface and the saturated steam.
2. Injecting about 3 kg/cm$^2$G or higher saturated steam enables high-temperature condensed water to be pressed into the lumber product via vessels and capillary tubes.
3. Because the contained water in the cell cavities does not move, it is necessary to transfer heat from the contained water heated in the vessels and capillary tubes in the vicinity of the cell cavity. Temperature in the cell cavities is not homogenized unless about 3 kg/cm$^2$G or higher saturated steam is injected in order to improve heat transfer.

The reason why the range of the fluctuating saturated steam is set to about 0.3 kg/cm$^2$G is described as follows. For example, if the fluctuation width of the saturated steam is set to the range of about 0.25 kg/cm$^2$G, the number of fluctuations increases even in the same time zone, but it is unable to homogenize the internal temperature of the lumber product. This phenomenon is based on many experimental examples and is assumed to be the phenomenon that occurs due to narrow vessels and capillary tubes of the lumber, but no theoretical analysis has been made to clarify the exact reasons for this issue.

The reason why the time range for fluctuating the saturated steam between the maximum and minimum press is set to 40–90 seconds is described as follows. Various attempts have been made based on the belief that as the fluctuating time gets shorter, the number of the fluctuation times of the saturated steam increases and the time for fluctuating the saturated steam can be shortened. However, it was not possible to find any tree types that could be operated at 40 seconds or less probably due to the thickness of the vessels or capillary tubes which the lumber possesses. When lumber products that were finished with the treatments of all of the processes were cross-cut and the cross-cut section was investigated, it was determined that there were tree types that generated irregularities in wet colors of the cross-cut section. If this occurred, it was found that by extending the time range for fluctuating the saturated steam enabled such color irregularities to completely disappear. The lumber products that generated even with a little color irregularity on the cross-cut section generated deformation in those products that were lumbered to a desired thickness after treatment. This result indicates that one should not continue operation with the time range established for fluctuating the saturated steam unless the treated lumber product is cross-cut and any presence of irregularity in wetting of the color of the cross-cut section is confirmed when the tree type is first treated.

Because the use of the machine and the technique recited herein can heat the water contained in the cell cavities of the lumber tissue to a uniform temperature, it is evident that by canceling the pressurized condition when the water contained in the lumber product achieves a uniform temperature under the pressurized condition enables the water contained inside the lumber product to simultaneously achieve a uniform boiling condition. It is known that water evaporates from the water surface but when water boils, the boiling phenomenon occurs not only from the water surface but also from the water bottom. When water boils, water becomes a gas. If part of the water contained in the cell cavities, even if it is a tissue with only one exit, a phenomenon occurs in that water in the form of a gas can pass through the water contained in the cell cavities and it becomes liberated to the outside of the lumber product. As a result, each cell cavity is changed to a new state where the cell cavity has a hollow portion from where the contained water has been liberated at a ratio in accordance with the amount of the water contained in each cell cavity.

In the lumber product, each cell cavity has a hollow portion from which the contained water is liberated. The water contained in the cell cavities, which has previously been assumed to be difficult to move, can move simultaneously to the hollow portion in the adjoining cell cavities. Further, the water contained in the cell cavities is able to be liberated in the same manner as in the case of the contained water remaining in the vessels and capillary tubes.

If the contained water remaining in the lumber product is uniformly liberated, occurrence of different contractions at each portion of the lumber product will not take place.

The various lumber academies in the world as well as the governments of all of the countries appear unable to shake themselves free of the established concept that water contained in the cell cavities of the lumber tissue is unable to be liberated simultaneously with the water contained in the vessels or capillary tubes. This is why they do not get rid of the traditional lumber seasoning methods that generate excessive losses.

The production machine and the operation software related to this invention are disclosed in detail in my international patent application and this is incorporated herein by reference.

The inventor would like to disclose that the following byproducts are able to be produced in addition to the remarkably increased yield ratio of the lumber and the capability to meet lumber demands in the world even if the amount of cutting down woods is reduced when the invention is applied. The inventor urges the world's lumber academies and lumber manufacturers to make the best use of the examples recited in the specification and to begin research as soon as possible because of the large possibility for producing a large number of new products in addition to those mentioned herein.

When the maximum temperature of the lumber in the pressure vessel reaches 120° C. (which is proportional to the use of steam pressure at 1 kg/cm$^2$G), then the saturated steam is discharged:

1. The resin contained in the lumber is chemically decomposed into turpentine and colophony by steam distillation, turpentine is liberated by passing through the boiling contained water and colophony is discharged from the pressure vessel together with the condensed water to remove resin contained in the lumber.

2. A large number of lumber products lumbered in the Continent of America are imported to Japan. However these lumber products are warped on the opposite side with respect to the center core of the log when sawed due to the properties of the lumber. Therefore there is no straight lumber. When such warped lumber product is treated by the method according to this invention, all of the warps are removed and straight lumber results. The lumber is then removed from the pressure vessel and let stand so that they rapidly dry without generating warpage again. Consequently, the 100-m tunnel kiln type drying machine adopted in the US does not need to be used.

3. There exists a large number of Japanese cedar trees whose heartwood portion becomes blackened. When these cedar trees are cut down and treated by the method according to this invention, the blackened portion is decolored and becomes similar to the original heartwood in the cedar, and it will not become discolored again.

4. Many lumber products such as cedar, pine, ramin, etc. cut in the spring or summer form a blue mold immediately. When such lumber is cut treated by the method according to this invention and removed from the pressure vessel, traverse warpage generated due to the lumber properties becomes smooth, the lumber that does not need to be artificial seasoned and it does not form a blue mold again. The lumber is then cut into a thickness with the contraction rate allowance taken into account. This lumber is cut with a thin saw while it is still hot just after it is removed from the pressure container, piled up on battens and naturally dried. When the water content reaches 20–22%, the lumber is processed into flooring, etc., and piled up on battens again and let stand in place so that a balanced water content is achieved at that place thereby producing products free of deformation. Consequently, there is no need to carry out the further processing after completion of seasoning as is the case when general lumber seasoning is used.

5. In the fall, bark of the log is difficult to peel but if the log is treated by the method according to the present invention, the bark peels off easily and the log can be treated in the same manner as described in Paragraph 4 above.

In the example described above, the treatment temperature of lumber is set at 120° C. which is proportional to the 1 kg/cm$^2$G steam. Almost all trees can be treated satisfactorily at that temperature. However, there are some kinds of trees which can stand compression of cell cavities even when heated to temperatures exceeding 120° C. Some of these trees have a poor color when the temperature exceeds 120° C., but in general, there are trees in North America which change into artistic colors when they are cut down and treated at temperatures slightly higher than 120° C.

For these trees, the treatment method that changes their original colors to artistic colors results in a profitable product.

It is to be understood that although the present invention has been described with regard to preferred embodiments thereof, various other embodiments and variants may occur to those skilled in the art, which are within the scope and spirit of the invention, and such other embodiments and variants are intended to be covered by the following claims.

The disclosure of Japanese application no. 254146 filed Sep. 2, 1997 is incorporated herein by reference.

What is claimed is:

1. A lumber production machine for processing lumber comprising:

a pressure vessel that can accommodate untreated lumber;

an injection pipe disposed in said pressure vessel, said injection pipe being capable of injecting saturated steam into the pressure vessel;

a pressure gauge operatively coupled with said pressure vessel to determine the pressure inside said pressure vessel;

setting means for setting a minimum and maximum pressure inside said pressure vessel;

a solenoid valve for controlling injection of saturated steam from said injection pipe; and a controller for opening said solenoid valve when the minimum pressure set by said setting means is reached and closing said solenoid valve when the maximum pressure set by said setting means is reached.

2. The lumber production machine as claimed in claim 1, wherein said pressure gauge is a three-pointer pressure gauge in which the minimum and maximum pressures inside said pressure vessel can be set with two pointers.

3. The lumber production machine as claimed in claim 1, wherein said pressure gauge includes a pointer for indicating the pressure inside said pressure vessel.

4. The lumber production machine as claimed in claim 1, wherein said machine includes a connection to a boiler that is made through a pressure reducing valve so that saturated steam can pass from the boiler to the pressure reducing valve and then to said pressure vessel.

5. A manufacturing method for forming lumber that does not need any artificial seasoning, comprising the steps of:

placing lumber products containing natural water in a pressure-vessel type production machine;

pressurizing and heating the lumber products with saturated steam with pressure varying between first maximum and minimum pressures, said pressurizing and heating step including providing saturated steam in the pressure-vessel type production machine at substantially 3 $kg/cm^2G$ or higher;

pressurizing and heating the lumber products with saturated steam with pressure varying between second maximum and minimum pressures, said pressurizing and heating step including providing saturated steam in the pressure-vessel type production machine at substantially 3 $kg/cm^2G$ or higher;

controlling the saturated steam pressure in the vessel so that the time between the first minimum pressure and first maximum pressure is in the range of 40 to 90 seconds, and discharging the saturated steam of the production machine to produce a boiling phenomenon for the natural water.

* * * * *